United States Patent [19]

Landwehr

[11] Patent Number: 4,563,889

[45] Date of Patent: Jan. 14, 1986

[54] SCREW PRESS

[75] Inventor: Hubert Landwehr, Neuss, Fed. Rep. of Germany

[73] Assignee: SMS Hasenclever Maschinenfabrik GmbH, Dusseldorf, Fed. Rep. of Germany

[21] Appl. No.: 589,030

[22] Filed: Mar. 13, 1984

[30] Foreign Application Priority Data

Mar. 17, 1983 [DE] Fed. Rep. of Germany ..... 3309594
Apr. 14, 1983 [DE] Fed. Rep. of Germany ..... 3313472

[51] Int. Cl.[4] ..... B21J 9/18

[52] U.S. Cl. ..... 72/454; 72/453.02; 100/289

[58] Field of Search ..... 72/454, 453.02, 453.03, 72/449, 112; 100/289, 270

[56] References Cited

U.S. PATENT DOCUMENTS

| | | | |
|---|---|---|---|
| 3,426,574 | 2/1969 | Voronak | 100/299 |
| 3,830,615 | 8/1974 | Walchhuetter | 72/454 |
| 4,207,763 | 6/1980 | Huydts et al. | 72/454 |

FOREIGN PATENT DOCUMENTS

| | | | |
|---|---|---|---|
| 567536 | 8/1977 | U.S.S.R. | 72/454 |
| 617282 | 7/1978 | U.S.S.R. | 72/454 |

OTHER PUBLICATIONS

*Hansenclever,* "Hydraulically Driven Screw Presses HSPRZ", 6/1981, pp. 1–8, Mashinenfabrik Hasenclever GmbH, Witzelstr. 55, 4000 Düsseldorf 1.

*Primary Examiner*—Daniel C. Crane
*Assistant Examiner*—David B. Jones
*Attorney, Agent, or Firm*—Holman & Stern

[57] ABSTRACT

A screw press has a flywheel rotationally connected to the press spindle by way of a friction coupling. The spindle is displaced axially in a nut mounted in the upper cross member of the press frame, and the flywheel has external toothing with a width corresponding to the maximum pressing stroke plus the width of the driving pinions. A plurality of pinions engaging in the said toothed rim are each driven by an oil-hydraulic axial piston motor or by a pair of oil-hydraulic axial piston motors and the axial piston motors together with the pinions are disposed on a platform surrounding the upper cross member of the press frame. In order to reduce the structural expenditure and to increase the operational reliability, each axial piston motor or pair of axial piston motors associated with a pinion has associated with it on the platform a controllable pump which is driven by a respective electric motor and is reversible with respect to the flow direction.

5 Claims, 4 Drawing Figures

SCREW PRESS

BACKGROUND OF THE INVENTION

1. Field of the Invention

The invention relates to a screw press having a flywheel rotationally connected to the spindle by way of a friction coupling and a spindle displaceable axially in a nut mounted in the upper cross member of the press frame, wherein the flywheel has external toothing to a width corresponding to the maximum press stroke plus the width of the driving pinion, a plurality of pinions engaging in the said toothed rim are each driven by oil-hydraulic axial piston motors or by a pair of oil-hydraulic axial piston motors and the axial piston motors together with the pinions are disposed on a platform surrounding the upper cross member of the press frame.

2. Description of the Prior Art

Screw presses, which are preferably used as drop-forging machines on account of their design advantages, are restricted in their impact force by friction wheel drive (friction screw presses), and therefore screw presses with an impact strength of from 40 MN (Meganewtons) are frequently provided, and screw presses with an impact of from 80 MN are in general provided, with a gearwheel drive, for which purpose the flywheel has external toothing and has motor-driven pinions engaging in its toothed rim. Electric motors or oil-hyraulic motors are used for driving the pinions.

Electric drive has the advantage of simpler energy supply, but high peak currents occur since the necessary energy to be stored in the flywheel must be applied within the short period of the stroke in which the flywheel is to be accelerated to the required rotational speed.

Special arrangements are therefore frequently necessary for limiting the peak currents, and this renders the plant expensive and leads to a prolongation of the cycle time. Since the electric motors are twice accelerated from rest to the required rotational speed and braked again during each operating cycle, correspondingly high current heat losses are unavoidable and also the idle power absorbed by the motor is disadvantageous. The torque to be applied necessitates correspondingly large and heavy motors which, apart from the fact that they have an unfavorable ratio of torque to moment of inertia, lead to the structural disadvantage that the spindle together with the flywheel and toothed rim must be mounted axially non-displaceably in the upper cross member of the press frame and the spindle nut must be mounted in the slide of the press, and this results in unfavorable exposure of the spindle to pressure and torsion.

Oil-hydraulic motors, in particular axial piston motors, have a subtantially lower specific weight with small dimensions than electric motors, so that they can be arranged, individually or in pairs, on diametrically opposite a driving pinion, with the further structural advantage that the spindle together with the flywheel and the toothed rim can be mounted axially displaceably in a nut mounted in the upper cross member of the press frame and are thus exposed only to torsion above the nut and only to thrust below the nut. In order to supply the oil-hydraulic motors, an oil station is required which comprises an electric motor, oil pump, high-pressure accumulator and control devices as well as devices for filtering and cooling the oil, and which in addition to the press is disposed on the workplace floor, in a basement or on a scaffold and is connected to the oil-hydraulic motors by way of flexible high-pressure ducts which compensate for the movements of the press. The structural expenditure for this is considerable, in particular when subject to the requirements of operational reliability.

BRIEF SUMMARY OF THE INVENTION

The object of the invention is to reduce the structural cost of these screw presses at the same time as increasing operational reliability.

According to the invention each axial piston motor or each pair of axial piston motors respectively associated with a pinion has associated with it on the platform a controllable pump which is driven by a respective electric motor and is reversible with respect to the fluid supply direction.

Although the advantage, of reduced cost and greater reliability are achieved at the cost of a higher electric motor drive capacity, since the substantial load compensation made possible by the hydraulic accumulator in the case of the previous type of drive with a central oil supply is absent, the electrical disadvantages (in particular high load peaks, additional installations for limiting them, idle power of the motors) and the structural disadvantage of the spindle bearing in the case of a purely electrical drive are avoided, and with respect to the operational reliability in the case of the oil-hydraulic drive any disadvantage due to provision of further hydraulic components (oil pumps and control means for each oil motor or pair of oil motors associated with a pinion) is more than compensated by the absence of the high-pressure oil ducts, in particular of the flexible portions compensating the movements of the press. Viewed as a whole the advantages of the press according to the invention outweigh known presses.

It is possible to form the platform surrounding the upper cross member of the press frame as a storing and cooling tank for the oil. In order to increase the operational reliability, according to a further feature of the invention the platform is formed as a trough which surrounds the upper cross member and which receives the oil storing and cooling tank, the filters for the oil and the control means in the oil circuit and is dimensioned and formed as a leakage chamber for the entire quantity of oil in the oil circuit.

A compact design and an increase in operational reliability are achieved if, each axial piston motor or each pair of axial piston motors which is associated with a pinion and the associated reversible pump are disposed in a closed circuit which also contains the control means for feed pressure and multiple-stage pressure controllable in one stage as braking pressure and which is connected to a refill pump.

BRIEF DESCRIPTION OF THE DRAWINGS

An exemplary embodiment of the invention will now be described in detail with reference to the accompanying drawing, wherein.

DETAILED DESCRIPTION

Figure 3:
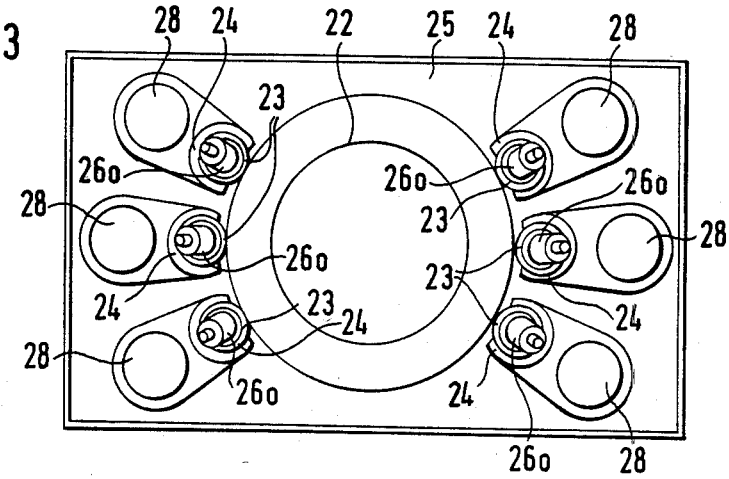
FIG. 3 is a top plan view thereof.

The stand or frame 1 of the screw press is formed by a lower cross member 2 which at the same time forms the foot of the press and an upper cross member 3, the columns 4 and the four pre-tensioned tie bars 5 which connect the cross members 2 and 3 and the columns 4 with their heads 6. The vertically movable slide or platen 7, which supports the upper half of a drop-forge die (not shown), the lower half of which is secured to the table area 8 of the lower cross member 2, is guided by the columns 4. The slide 7 is moved by a threaded spindle 9 which is rotatably inserted in a nut 10 mounted in the upper cross member 3 of the press frame 1. In the axial direction the nut 10 is supported on the one hand by shouldered surfaces in the correspondingly recessed bore in the cross member 3 and is held on the other hand by a ring 11 which is secured to the cross member 3. A means (not shown) for preventing the nut 10 from rotating is also provided in the cross member 3. The head 12 at the lower end of the spindle 9 is connected by a double-acting axial bearing 13 to the slide 7 so as to be rotatable but axially non-displaceable with respect thereto. The pin 14 of the spindle shaft 15 has secured to it a clutch disc 16 which is frictionally connected to a flywheel 17, for which purpose the clutch disc 16 is clamped between the hub 18 of the flywheel 17 and a thrust ring 19 by clamping bolts 20. The torque which can be transmitted by friction can be adjusted by adjusting the tension of sets of springs 21 on the clamping bolts 20. The rim 22 of the flywheel 17 has external toothing over its entire width and is driven by pinions 23 engaging in the external toothing. A plurality of the pinions 23 are disposed over the periphery of the toothed rim 22, six pinions 23 in the exemplary embodiment, as shown in FIG. 3. The pinions 23 are mounted in bearing blocks 24 which are supported by a platform 25 which surrounds the upper cross member 3 of the press frame 1. Each pinion 23 is driven by two axial piston motors, an axial piston motor **26*o* disposed above the pinion and an axial piston motor 26*u* disposed below the pinion 23. The width of the toothed rim 22 is such that during the full stroke of the spindle 9 executed by the toothed rim 22 the pinions 23 are at all times in complete engagement with the external toothing of the rim 22**.

The two axial piston motors **26*o* and 26*u* associated with a respective one of the pinions 23 are each fed by an oil pump 27 which in turn is driven by a respective electric motor 28 in each case, the bearing block 24 of each pinion 23 simultaneously supporting the axial piston motors 26*o* and 26*u*, the oil pump 27 and the electric motor 28, which are associated with this pinion 23. Each oil pump 27 can be regulated in terms of its feed pressure and its feed quantity and is reversible with respect to its feed direction. Each oil pump 27 is connected by way of two parallel ducts 29 to a control block 30 which contains the control means and which in turn is connected again by way of two parallel ducts 31 to the associated upper and lower axial piston motors 26. The numeral 32 designates a tank or tanks for the storage, cooling and filtering of oil, from which the oil is removed for replenishing the circuits and by which oil draining out of the circuits is collected. Each circuit can have associated with it its own oil tank 32, or the circuits of one half of the press or all the circuits can have a common oil tank 32. The platform 25 is formed as a trough 33 with inner side walls 33*i*, outer side walls 33*a* and the base 33*b*, the trough 33** supporting the entire oil hydraulic system and being adequately dimensioned to receive all the oil present in the oil circuit.

Figure 1:
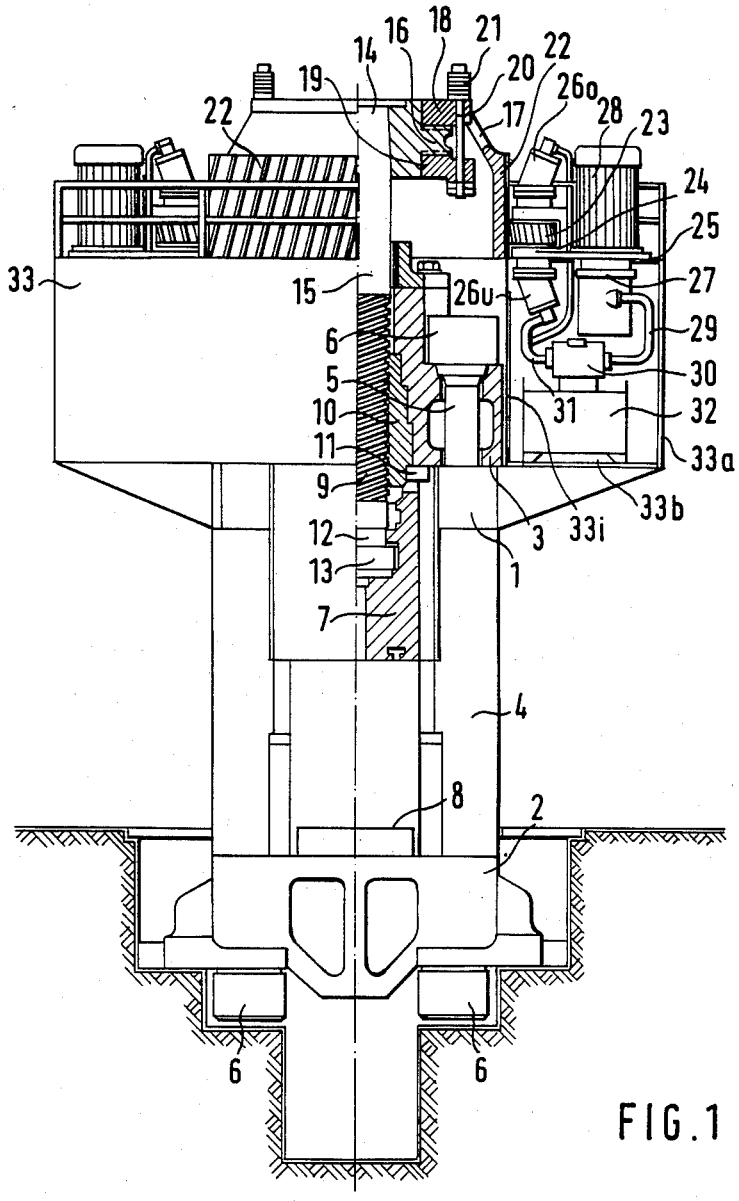
FIG. 1 is a partially cut away front elevation and partial cross-sectional view of a screw press according to the invention.
Figure 2:
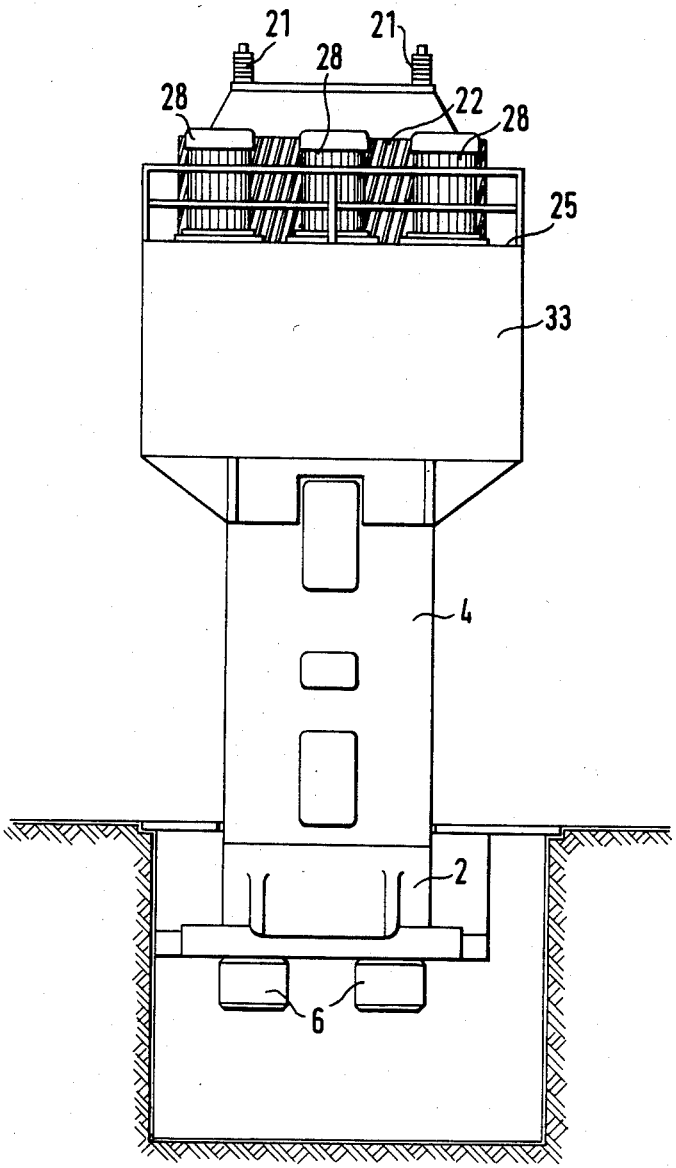
FIG. 2 is a side elevational view thereof.
Figure 4:
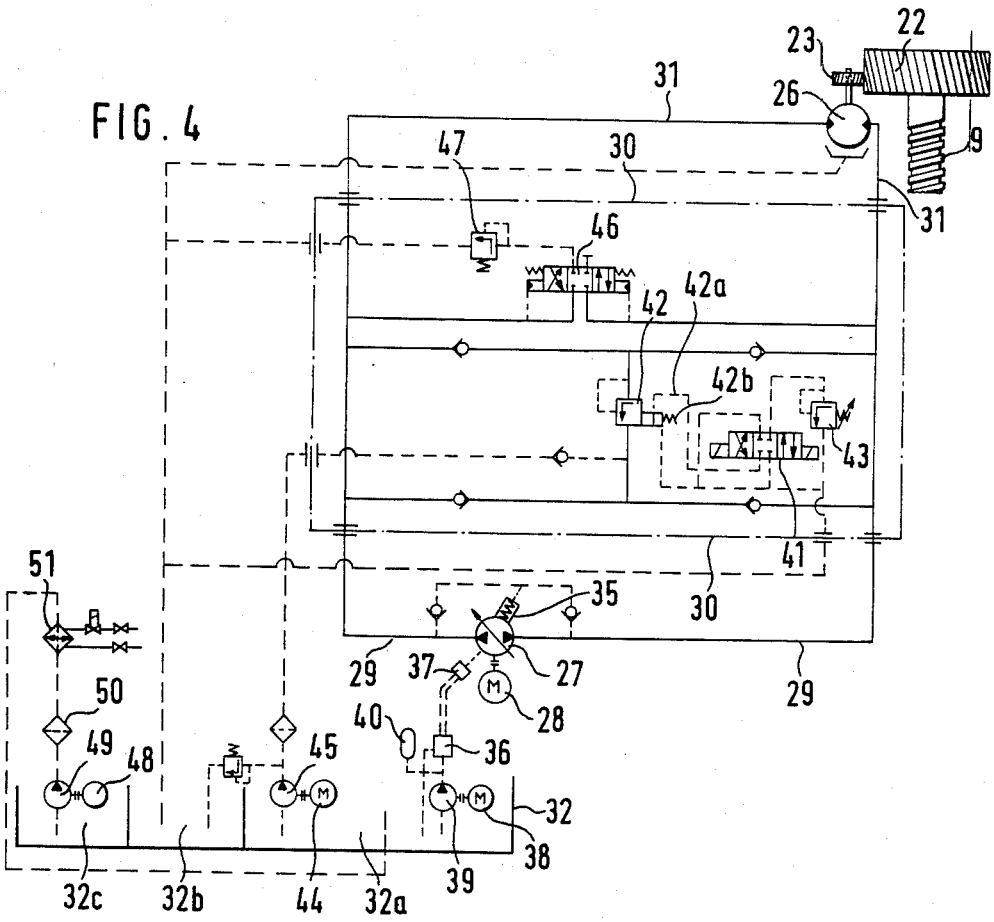
FIG. 4 is a circuit diagram of the hydraulic system.

Further details of the drive are described with reference to the hydraulic diagram of FIG. 4. The spindle 9 and the flywheel 17 connected thereto together with the toothed rim 22 are driven by way of a plurality of pinions 23 (six in the example according to FIGS. 1 to 3) only one of which is shown in FIG. 4. Each pinion 23 is driven by a pair of axial piston motors or, as shown in FIG. 4, by one axial piston motor 26. The axial piston motor 26 is fed by the oil pump 27 which is driven by the electric motor 28. When the feed direction of the pump 27 is reversed there is also a change in the direction of rotation of the axial piston motor 26 which in one direction of rotation effects the downward movement of the spindle 9 for the working stroke and in the other direction of rotation effects the upward movement of the spindle 9 in order to return to the starting position. During the acceleration phases for the downward movement and the upward movement of the spindle 9 the electric motor 28 operates with approximately constant power and constant rotational speed which ensures a high degree of electrical efficiency of the motor 28. The constant motor power is converted and fully utilized by the oil pump 27 operating as a torque converter. For this purpose the oil pump 27 is provided with a pressure gauge 35 and an actuating drive 37 which is actuated as a function of pressure by way of a control 36 and which in the case of an axial piston pump preferably used in this connection causes the piston axes to pivot towards the drive axis. For the working stroke and the return stroke of the spindle 9 the extent of pivoting is limited to a pivot angle which corresponds to the rotational speed of the spindle desired in each case and which determines the delivery of the pump 27 at a constant rotational speed of the electric motor 28. A piston-cylinder arrangement, which is acted upon, by way of the control 36, by a pump 39 driven by an electric motor 38 in conjunction with a pressure accumulator 40, acts as the actuating drive 37.

During the working stroke of the spindle 9, i.e. the downward movement of the slide 7, the flywheel 17 is accelerated by the drive until it reaches the preselected rotational speed, i.e. has accumulated the energy required for the forging process. The delivery of the pump 27 which corresponds to this rotational speed is maintained unchanged, i.e. the rotational speed of the flywheel 17 as well. Shortly before the impact of the upper half of the forging die, secured to the slide 7 upon the forging work-piece lying in the lower half of the forging die, the lines 31 to the axial piston motor 26 are short-circuited, as the magnetically controlled four-way valve 41 is moved from its rest position (as shown in FIG. 4) to the left. In the rest position of the four-way valve 41, a line **42*a* connecting the said four-way valve 41 to a pressure-limiting valve 42 is closed, so that the full pressure (maximum operating pressure) present at the pressure-limiting valve 42 and adjustable by the pressure control valve 42*b* builds up in this line, when the control plunger is displaced to the left in the four-way valve 41, the lead 42*a* is without pressure, so that the pressure-limiting valve 42, operating only against the negligible pressure of a closing spring (not shown) in the pressure-limiting valve 42, short circuits the lines 31. During this the pump 27 is reversed with respect to its flow direction. Immediately after the press blow the four-way valve 41 returns to the rest position, so that the spindle 9 is now driven in the reverse direction of rotation and is accelerated to a predetermined rotational speed. Shortly before the end of the downward stroke of the spindle 9 the rotational speed of the pump 27 and hence the rotational speed of the flywheel 17 and the spindle 9 are reduced to zero during the rest of the stroke of the spindle 9. When the rotational speed is reduced the four-way valve 41 is displaced from the rest position to the right and the line 42***a* is connected to a second pressure-limiting valve 43. The pressure which can be regulated by the pressure-limiting valve 43 limits, by way of the pressure-limiting valve 42, the pressure present in the pipeline 31 to the braking pressure required for braking the flywheel 17.

The small quantities of oil running off from the pressure-limiting valves 42 and 43 and the four-way valve 41 during the reversing and also as leaked oil are fed back again into the closed circuit by a pump 45 driven by a motor 44. A spring-centered, pressure-controlled three-way valve 46 is provided in order to ensure the feed pressure required at the pump 27 and regulated by the pressure-limiting valve 47. The three-way valve 46 is actuated in such a way that the respective low-pressure side of the closed circuit is connected to the pressure-limiting valve 47, the feed pressure being maintained by the pump 45. For cleaning and cooling the oil, the oil which has escaped from the circuit, is collected in part 32*b* of the tank 32, passed on after preliminary cleaning by sedimentation to part 32*c* of the tank 32, is fed through filters 50 and coolers 51 by a pump 49 driven by an electric motor 48 and is stored in part 32*a* of the tank 32.

According to the exemplary embodiment an axial piston motor 26 (fixed displacement motor) and an axial piston pump 27 (variable displacement pump), i.e. axial piston machines, are provided as these are the most suitable. The invention, however, is not restricted to these axial piston machines, but suitable oil pumps and oil motors of other design can also be used. The oil motor 26 and the oil pump 27 can also be driven in an open circuit instead of the preferred closed circuit according to the exemplary embodiment.

I claim:

1. A screw press comprising:

a press frame;

an upper cross member on said frame;

a platform on said frame surrounding said upper cross member;

a press spindle;

a flywheel rotatably mounted on said frame;

a friction coupling operatively connecting said flywheel to said spindle so that rotation of said flywheel rotatably drives said spindle;

an internally screw threaded nut non-rotatably mounted in said upper cross member;

an external screw thread on said spindle in axially displaceable screw threaded engagement with said nut;

external gear teeth on said flywheel;

a plurality of external gear toothed pinions rotatably supported on said platform operatively engaging said external teeth on said flywheel so that rotation of said pinions rotatably drives said flywheel;

said external teeth on said flywheel having an axial length at least as great as the maximum press stroke plus the axial length of said teeth on said pinions;

respective oil-hydraulic axial piston motor means mounted on said platforms and operatively connected to each pinion for rotatably driving each pinion; and a respective fluid supply means for driving each piston motor means comprising, a separate controllable hydraulic pump mounted on said platform operatively connected to a respective axial piston motor means for pumping oil-hydraulic fluid to drive said motor means, said pump being reversible with respect to the fluid flow direction to operate said motor means to drive said respective pinion in opposite directions, and an electric motor for each pump mounted on said platform operatively connected to a respective pump to drive said respective pump.

2. A screw press as claimed in claim 1 wherein, said piston motor means for each pinion comprises a pair of oil-hydraulic piston motors.

3. A screw press as claimed in claim 1 wherein said platform is formed as a trough, and further comprising:

a hydraulic fluid circuit; and a storage tank, oil cooler, oil filter means and central means operatively connected in said fluid circuit and disposed in said trough, said trough being adapted as a leakage chamber for the entire quantity of fluid in said circuit.

4. A screw press as claimed in claim 1 wherein each respective axial piston motor means and hydraulic-pump are operatively connected in a closed hydraulic circuit;

said circuit further comprising control means for controlling the pressure of the hydraulic fluid fed to said motor means and a plurality of pressure stages, one of said stages being controllable as braking pressure for said flywheel, and a refill pump means for returning leaked hydraulic fluid to said circuit.

5. A screw press as claimed in claim 3 wherein each respective axial piston motor means and hydraulic-pump are operatively connected in a closed hydraulic circuit;

said circuit further comprising control means for controlling the pressure of the hydraulic fluid fed to said motor means and a plurality of pressure stages, one of said stages being controllable as braking pressure for said flywheel, and a refill pump means for returning leaked hydraulic fluid to said circuit.

* * * * *